US005338406A

United States Patent [19]

Smith

[11] Patent Number: 5,338,406

[45] Date of Patent: Aug. 16, 1994

[54] DRY STRENGTH ADDITIVE FOR PAPER

[75] Inventor: Douglas C. Smith, Landenberg, Pa.

[73] Assignee: Hercules Incorporated, Wilmington, Del.

[21] Appl. No.: 943,106

[22] Filed: Sep. 10, 1992

Related U.S. Application Data

[63] Continuation of Ser. No. 730,187, Jul. 12, 1991, abandoned, which is a continuation of Ser. No. 252,333, Oct. 3, 1988, abandoned.

[51] Int. Cl.[5] ..... D21H 17/07; D21H 17/20

[52] U.S. Cl. ..... 162/168.2; 162/164.1; 162/168.3; 162/175; 162/177; 162/178

[58] Field of Search ..... 162/168.2, 168.3, 175, 162/177, 178, 183, 164.1

[56] References Cited

U.S. PATENT DOCUMENTS

| | | | |
|---|---|---|---|
| 2,884,057 | 4/1959 | Wilson et al. | 162/164 |
| 2,890,978 | 6/1959 | Woodberry et al. | 162/168 |
| 2,963,396 | 12/1960 | Padbury et al. | 162/168 |
| 3,049,469 | 8/1962 | Davison | 162/164 |
| 3,303,184 | 2/1967 | Nordgren | 260/209 |
| 3,332,834 | 7/1967 | Reynolds | 162/164 |
| 3,660,338 | 5/1972 | Economou | 260/29.6 |
| 3,677,888 | 7/1972 | Economou | 162/164 |
| 3,819,555 | 6/1974 | Kaufman | 260/29.4 |
| 3,840,489 | 10/1974 | Strazdins | 260/29.6 |
| 3,874,994 | 4/1975 | Sedlak | 162/163 |
| 3,875,097 | 4/1975 | Sedlak | 260/29.6 |
| 3,875,098 | 4/1975 | Sedlak | 260/29.4 |
| 4,002,588 | 1/1977 | Strazdins | 260/29.6 |
| 4,088,530 | 5/1978 | Chan et al. . | |
| 4,167,439 | 9/1979 | Killam | 162/163 |
| 4,347,100 | 8/1982 | Brucato | 162/10 |
| 4,702,844 | 10/1987 | Flescher et al. | 162/168.3 |
| 4,753,710 | 6/1988 | Langley et al. | 162/168.3 |

FOREIGN PATENT DOCUMENTS

| | | |
|---|---|---|
| 1110019 | 10/1981 | Canada . |
| 193111 | 9/1986 | European Pat. Off. . |
| 191394 | 11/1982 | Japan . |
| 78/2037 | 4/1978 | South Africa . |

OTHER PUBLICATIONS

Rydholm, "Pulping Processes", *Interscience Publishers*, New York, Sep. 1967, pp. 1135–1138.

Linhart et al., "Anionic Trash: controlling detrimental substances", *TAPPI Journal*, Oct. 1987, pp. 79–85.

Auhorn et al., "Improved Efficiency of Wet End Additives in Closed Wet End Systems through Elimination of Detrimental Substances" TAPPI Papermakers Conference, *TAPPI Press*, Atlanta, Ga., 1979.

Springer et al., "The Effects of Closed White Water System Contaminants on strength Properties of Paper Produced from Secondary Fiber", *TAPPI Journal*, Apr. 1985, pp. 78–82.

Springer et al., "Contaminants Versus Retention Aids", *Southern Pulp and Paper*, Mar. 1984, pp. 21–25.

*Database W/PIL, No. 83-744757*, Derwent Publications Ltd., London, Great Britain, published Oct. 5, 1983.

*Abstract Bulletin of the Institute of Paper Chemistry*, vol. 51, No. 11, May 1981, p. 124, No. 11644, Appleton, Wisc., USA.

*Primary Examiner*—Steve Alvo

*Attorney, Agent, or Firm*—Ivan G. Szanto

[57] ABSTRACT

A polyelectrolyte complex comprising at least one water-soluble, linear, high molecular weight, low charge density cationic polymer having a reduced specific viscosity greater than 2 deciliters/gram (at 0.05 weight % in a 2M NaCl solution at 30° C.) and a charge density of 0.2 to 4 milliequivalents/gram (meq/g), and at least one water-soluble, anionic polymer having a charge density less than 5 meq/g, an aqueous system comprising the polyelectrolyte complex, a composition comprising the polymers which form the polyelectrolyte complex, and paper comprising the polyelectrolyte complex. It is also directed to a process comprising (1) forming an aqueous suspension of cellulosic fibers; (2) adding a strengthening additive so that the aforementioned polyelectrolyte complex is incorporated into the aqueous suspension of cellulosic fibers; and (3) sheeting and drying the fibers to form the desired cellulosic web.

23 Claims, No Drawings

DRY STRENGTH ADDITIVE FOR PAPER

This application is a continuation of application Ser. No. 07/730,187, filed Jul. 12, 1991, now abandoned, which is a continuation of 07/252,333, filed Oct. 3, 1988, now abandoned.

This invention is directed to a novel polyelectrolyte complex, a novel aqueous system comprising the polyelectrolyte complex, a novel composition comprising the polymers which form the polyelectrolyte complex, and paper comprising the polyelectrolyte complex. It is also directed to a novel papermaking process wherein the polyelectrolyte complex is used to provide dry strength to the resultant paper.

BACKGROUND OF THE INVENTION

The production of paper of improved dry strength from pulps composed of unbleached fibers, especially when the pulp contains black liquor, has presented a special problem to the paper manufacturing art. Most dry strength polymers (both anionic and cationic) of ordinarily excellent dry strengthening capabilities have proved to be inadequate when used with such pulps. Therefore, there exists a need for new dry strength additives which improve dry strength when used in pulps composed of unbleached fibers, particularly where the pulp contains black liquor.

Polyacrylamides are disclosed in a number of patents to improve dry strength. For instance, Wilson, in U.S. Pat. No. 2,884,057, describes use of a small amount of a normally water-soluble high molecular weight, synthetic, hydrophilic, cationic, linear chain polymer carrying quaternary ammonium groups which will increase dry strength. Woodberry et al, in U.S. Pat. No. 2,890,978, disclose use of a cationic water-soluble polymer prepared by subjecting a water-soluble polyacrylamide having an average molecular weight in excess of about 10,000 to the Hofmann reaction until between about 0.1% and 15% of the amide groups therein have been degraded to amino groups. And, Padbury et al, in U.S. Pat. No. 2,936,396, disclose use of a normally water-soluble cationic linear acrylamide-vinylpyridine copolymer having 75–99 percent, by weight of the polymer, acrylamide units and a molecular weight of at least 10,000.

Guar and its derivatives are also known as dry strength additives. For example, Nordgren, in U.S. Pat. No. 3,303,184, discloses use of aminoethyl gums, such as aminoethyl ethers of guar, as dry strength additives.

A number of acrylamide copolymers have been developed in attempting to provide increased dry strength to papers made from unbleached pulps, and, more particularly, those containing black liquor. Kaufman, in U.S. Pat. No. 3,819,555, discloses autodispersible, nonionic, anionic, cationic and amphoteric vinyl polymers containing at least 60 weight percent acrylamide linkages and at least 5 weight percent of acrolein linkages. It is disclosed that the anionic and cationic polymers provide improved dry and wet strength when added to unbleached pulps, and pulps containing black liquor. Strazdin, in U.S. Pat. No. 3,840,489, discloses substantially autodispersible vinylamide polymers comprising at least 60 weight percent of unsubstituted vinylamide linkages as dry strengthening components and at least 5 weight percent of hydrophobic linkages as components for improving absorptivity to cellulose. The latter polymers may also carry a small amount of anionic or cationic substituents.

Killiam, in U.S. Pat. No. 4,167,439, discloses that a nonionic copolymer composed of 5 to 30 weight % N-vinyl pyrrolidone, 15 to 60 weight % acrylamide, and 30 to 70 weight % methyl methacrylate is useful as dry strength additive when used in the presence of black liquor.

Other acrylamide copolymers, disclosed to be water-insoluble or dispersible, are stated to be useful as dry strength additives for use with unbleached pulps containing black liquors. For instance, Sedlack, in U.S. Pat. Nos. 3,874,994, 3,875,097, and 3,875,098 discloses use of a water-insoluble polymer containing at least about 60 weight percent of unsubstituted acrylamide linkages, at least about 5 weight percent of hydrophobic linkages, and at least about 2 weight percent of N-[di-($C_{1-3}$alkyl-)amino methyl]acrylamide.

Combinations of anionic and cationic polymers have also been described to be useful in improving dry strength. Davison in U.S. Pat. No. 3,049,469, discloses that a water-soluble, carboxyl containing polymer can be impregnated to a fibrous cellulosic material when a cationic thermosetting polyamide-epichlorohydrin resin is added to the papermaking system. Reynolds, in U.S. Pat. No. 3,332,834, discloses a complex comprised of anionic polyacrylamide, water-soluble non-thermosetting resin and alum. And, Strazdins, in U.S. Pat. No. 4,002,588, discloses a polysalt which consists essentially of an anionic acrylamide-styrene-acrylic acid interpolymer (molar ratio, respectively, of 94-65:5-15:1-20) and a water-soluble cationic polyamine having a molecular weight in excess of 1,000 is an efficient strengthening agent, even when used with unbleached pulps containing black liquor.

Economou, in U.S. Pat. Nos. 3,660,338 and 3,677,888, discloses a strength additive consisting essentially of (a) an ionically self-crosslinked polysalt of a normally water-soluble polyanionic polymer with a normally water-soluble polycationic polymer, at least one polymer of which is a weak electrolyte having an ionization constant less than $10^{-3}$ and (b) a water-soluble ionization suppressor.

Woodberry et al, in South African Patent Application No. 78/2037, disclose water-soluble dry strength polymers, which are asserted to be suitable for the manufacture of paper from unbleached fibers, both in the presence of and in the absence of black liquor, comprising acrylamide linkages and N-[di-($C_{1-3}$alkyl) aminomethyl]acrylamide linkages having the specified formulae in a mole ratio of 98:2 to 50:50, respectively. These polymers may have additional linkages, which are nonionic, anionic or cationic, including cationic dimethyl diallyl ammonium chloride and 2-dimethylaminoethyl acrylate linkages. They have a viscosity of 2 to 10 centipoises (cps), preferably 3 to 8 cps, in a 0.5% aqueous solution at pH 11° and 25° C.

Brucato, in U.S. Pat. No. 4,347,100, discloses that addition of an anionic organic surface active agent into mechanical or thermomechanical pulp at elevated temperature and pressure is effective to cause dispersion of the lignin and to retard redeposition or coating of the lignin on the fibers during defibering of the wood and during subsequent cooling of the pulp. Useful water-soluble anionic agents are disclosed to be relatively high molecular weight anionic organic polyelectrolytes or polymers, such as sodium lignin sulfonates, or relatively lower molecular weight anionic detergents. The resultant pulp is disclosed to have improved strength. Further improvement of the strength is disclosed to be achieved by incorporating in the furnish a cationic organic polyelectrolyte or polymer that is capable of reacting with the anionic additive to form a polysalt. Best results are disclosed to result when starch is added with the cationic component.

Yamashita, in Japanese Kokai No. 191394-82, discloses the addition of low molecular weight cationic polymers having a charge density of at least (or more than) 3.0 meq/g, preferably at least 5.0 meq/g, to unbleached pulp containing at least 3 percent, based on the weight of the pulp, of lignin to improve the dry strength of the resultant paper. This lignin is generally present in the black liquor. However, where sufficient lignin is not present in the pulp, additional amounts may be added.

Yamashita also describes that the prior art includes use of an anionic or weakly cationic water-soluble polymeric substance, of greater molecular weight than his cationic polymers, in combination with lignin to improve dry strength, but that the prior art processes do not provide improved dry strength.

Canadian Patent Application No. 1,110,019 discloses a process for manufacturing paper having improved dry strength using, first, a water soluble cationic polymer having a viscosity greater than about 5 cps in a 10% aqueous solution at 25° C. and, subsequently, a cation content of greater than about 1.0 gram ion/kg polymer in combination with a water soluble anionic polymer. Exemplary cationic components include a copolymer of acrylamide and methacryloyloxyethyltrimethyl ammonium chloride having a viscosity of 9800 cps (10% solution) and a cationic content of 2.68 gram ion/kg polymer, a copolymer of acrylamide and methacryloyloxyethyltrimethyl ammonium chloride having a viscosity of 9700 cps (10% solution) and a cationic content of 1.64 gram ion/kg polymer, and a copolymer of acrylamide and dimethyldiallyl ammonium chloride having a viscosity of 33 cps and a cationic content of 2.21 gram ion/kg polymer.

The aforementioned dry strength additives have not been found to provide suitable results with unbleached pulps containing black liquors. Therefore, there has been a need for a dry strength additive that provides improved dry strength to paper products produced using unbleached pulps, particularly those containing black liquors, and a papermaking process whereby paper products have improved dry strength may be produced from such pulps.

SUMMARY OF THE INVENTION

Accordingly, this invention is directed to a polyelectrolyte complex comprising at least one water-soluble, linear, high molecular weight, low charge density cationic polymer having a reduced specific viscosity (RSV) greater than 2 deciliters/gram (dl/g) (at 0.05 weight % in a 2M NaCl solution at 30° C.) and a charge density of 0.2 to 4 milliequivalents/gram (meq/g), and at least one water-soluble, anionic polymer having a charge density less than 5 meq/g, an aqueous system comprising such a polyelectrolyte complex, a composition comprising the polymers which form the polyelectrolyte complex, and paper comprising the polyelectrolyte complex. This invention is also directed to a process comprising (1) forming an aqueous suspension of cellulosic fibers; (2) adding a strengthening additive such that the aforementioned polyelectrolyte complex is incorporated into the aqueous suspension of cellulosic fibers; and (3) sheeting and drying the fibers to form the desired cellulosic web.

DETAILED DESCRIPTION OF THE INVENTION

The polymers useful in this invention are water-soluble cationic and anionic polymers. By "water-soluble" it is meant that the polymers form a non-colloidal 1% aqueous solution. By "linear" it is meant that the polymers are straight-chained, with no significant branching present. Exemplary polymers are described below.

The term "improved dry strength" as used herein, means that the strength of the cellulosic web or paper prepared using a specific dry strength additive has a greater dry strength than that of a similar cellulosic web or paper prepared without a dry strength additive.

"Charge Density" can be determined based on the known structure of the polymer by calculating as follows:

$$\text{charge density (meq/g)} = \frac{1000}{\text{molecular weight per charge}}.$$

It may also be determined by experimentation, for instance, by using the colloidal titration technique described by L. K. Wang and W. W. Schuster in Ind. Eng. Chem., Prd. Res. Dev., 14(4)312 (1975).

Herein, molecular weight is expressed in terms of the polymers reduced specific viscosity (RSV) measured in a 2M NaCl solution containing 0.05 weight percent of the polymer at 30° C. Under these conditions, a cationic acrylamide copolymer of molecular weight $1\times10^6$ has a RSV of approximately 2 dl/g.

The polyelectrolyte complex may be soluble, partially soluble or insoluble in water. Thus, it forms what may be conventionally termed a "solution", "suspension", "dispersion", etc. Herein, to avoid confusion, the term "aqueous system" will be used to refer to the same. In some instances the term "aqueous system" is also used with respect to aqueous solutions of the water-soluble polymers that form the polyelectrolyte complex.

The cationic polymers of this invention have a RSV greater than 2 dl/g, preferably in the range of about 10 to about 25 dl/g. They have a charge density in the range of from 0.2 to 4 meq/g, preferably 0.5 to 1.5 meq/g. Optimum performance is obtained with cationic polymers having a charge density of about 0.8 meq/g. Exemplary cationic polymers include polysaccharides such as cationic guar (e.g., guar derivatized with glycidyltrimethylammonium chloride) and other natural gum derivatives, and synthetic polymers such as copolymers of acrylamide. The latter include copolymers of acrylamide with diallyldimethylammonium chloride (DADMAC), acryloyloxyethyltrimethylammonium chloride, methacryloyloxyethyltrimethyl ammonium methylsulfate, methacryloyloxyethyltrimethyl ammonium chloride (MTMAC) or methacrylamidopropyltrimethylammonium chloride, etc. Preferred are copolymers of acrylamide with DADMAC or MTMAC.

Some of the cationic polymers described above may undergo hydrolysis of their ester linkages under conditions of high temperature, extreme pH's, or extended storage. This hydrolysis results in the loss of cationic charge and the introduction of anionic sites into the polymer. If sufficient hydrolysis occurs, the polymer solution may become hazy. However, this hydrolysis has been found to have no significant effect on the performance of the polymer so long as the net cationic charge density (sum of cationic polymer charge density (meq. +/g) plus anionic polymer charge density (meq. −/g)) remains within the ranges specified.

The anionic components of this invention include those normally present in unbleached pulps such as solubilized lignins and hemicelluloses; synthetic anionic polymers; and anionically modified natural polymers (i.e., those other than lignins and hemicelluloses). When present in the papermaking process in sufficient quantity, the anionic polymer normally present in unbleached pulps are preferred.

Solubilized lignins and hemicelluloses are normally present in unbleached pulps as a result of incomplete removal of materials solubilized during manufacture of the pulp. Such products result from both chemical and mechanical pulping.

Typically, black liquors, such as kraft black liquor or neutral sulfite brown liquor, comprise solubilized lignin and hemicellulose. Washed, unbleached pulp normally contains 1 to 10 weight percent black liquors.

Exemplary synthetic anionic polymers and anionically modified natural polymers useful in the present invention include copolymers of acrylamide and sodium acrylate, sodium methacrylate and sodium-2-acrylamide-2-methylpropane sulfonate; sodium carboxymethylcellulose; sodium carboxymethyl guar; sodium alginate; sodium polypectate; and poly(sodium-2-acrylamide-2-methylpropane sulfonate). They may be used by themselves or in any combination.

Also useful are anionically modified forms of lignin and hemicellulose, such as are obtained, e.g., by oxidation, sulfonation or carboxymethylation. Oxidized and sulfonated lignins and hemicelluloses are naturally present as by-products of the pulping process and are normally present in unbleached pulps useful in this invention. The naturally present lignins and hemicellulose may also be modified by synthetic processes such as oxidation, sulfonation and carboxymethylation.

The polyelectrolyte complex of this invention provides paper having improved dry strength in most papermaking systems. It is especially useful in the presence of the anionic materials found in unbleached papermaking systems, i.e., black liquors, as prior dry strength additives show reduced effectiveness in such systems.

The process for manufacturing paper comprises three principal steps: (1) forming an aqueous suspension of cellulosic fibers; (2) adding the strengthening additive; and (3) sheeting and drying the fibers to form the desired cellulosic web.

The first step of forming an aqueous suspension of cellulosic fibers is performed by conventional means, such as known mechanical, chemical and semichemical, etc., pulping processes. After the mechanical grinding and/or chemical pulping step the pulp is washed to remove residual pulping chemicals and solubilized wood components. These steps are well known, as described in, e.g., Casey, Pulp and Paper (New York, Interscience Publishers, Inc. 1952).

The second step may be carried out by adding the polyelectrolyte complex, or cationic component, or cationic and anionic components, or blends of the anionic and cationic components directly to the papermaking system. The individual components and blends of the components may be dry or they may be in aqueous systems. Further, this step may be carried out by forming an aqueous system comprising the polyelectrolyte complex, or polymer, or polymers, and adding the same to the papermaking system.

The third step is carried out according to conventional means, such as those described in, e.g., Casey, Pulp and Paper, cited above.

The polyelectrolyte complex forms when the components are mixed in an aqueous system, preferably under high shear. It may be formed and then added during the papermaking process, or may be formed in the papermaking process. In the latter instance, the cationic component may be added by itself to react with naturally present anionic polymers or may be simultaneously or successively added with an anionic component. When added successively, the anionic polymer is generally added prior to the cationic polymer in order to avoid flocculating the pulp. Here, the amount of each anionic polymer incorporated in the polyelectrolyte complex is proportional to the relative amount of that polymer in the system.

The specific amount and type of polyelectrolyte complex that is preferable will depend on, among other things, the characteristics of the pulp; the presence or absence of black liquors and, where present, the amount and nature thereof; characteristics of the polymers used to form the complex; the characteristics of the complex; the desirability of transporting an aqueous system comprising the polyelectrolyte complex; and the nature of the paper-making process in which the aqueous system is to be used. The polyelectrolyte complex will typically comprise polymers in a ratio of cationic polymer(s):anionic polymer(s) of 4:100 to 40:1, preferably 1:4 to 4:1. Aqueous systems formed prior to addition to the pulp normally comprise 0.1 to 10 weight percent, based on the weight of the water in the system, of the polyelectrolyte complex. Generally, the polyelectrolyte complex is effective when added to the stock in an amount of 0.1 to 15%, preferably 0.2 to 3%, by dry weight of the pulp.

The amount of anionic polymer to be used is dependent on the source of the anionic material. Naturally present anionic polymers are typically found at a level of 0.1 to 5%, based on the dry weight of the pulp. When anionic polymers are added to the system, the total weight of anionic polymers generally falls in the range of 0.1 to 10%, based on the dry weight of the pulp. Preferably, the total weight of added anionic polymers is in the range of 0.1 to 2.5%, based on the dry weight of the pulp.

The level of cationic polymer required is highly dependent on the level of anionic material present. The level of cationic polymer is generally 0.1 to 5%, preferably 0.1 to 2.5%, based on the dry weight of the pulp.

The anionic charge fraction is indicative of the nature of the polyelectrolyte complex. It can be determined by the following formula:

$$\text{anionic charge fraction} = \frac{\text{total anionic charge}}{\text{total anionic charge} + \text{total cationic charge}}$$

wherein the total anionic charge is determined by multiplying the absolute value of the charge density (electrostatic charge per weight of polymer, e.g., in meq/g) of each anionic polymer forming the polyelectrolyte complex by the weight of that polymer in the polyelectrolyte complex and adding the total charge of all of the anionic polymers. The total cationic charge is determined by multiplying the charge density of each cationic polymer forming the polyelectrolyte complex by the weight of that polymer in the polyelectrolyte complex and adding the total charge of all of the cationic polymers. Generally, the polyelectrolyte complex is completely soluble at an anionic charge fraction of less than 0.2, colloidal at an anionic charge fraction of 0.2 to 0.4, and fibrous (in some instances as a stringy gel that precipitates from solution, but which becomes colloidal under high shear) at an anionic charge fraction greater than 0.4. Polyelectrolyte complexes of this invention generally have an anionic charge fraction of 0.1 to 0.98, preferably an anionic charge fraction of 0.3 to 0.8, and more preferably 0.45 to 0.6. All polyelectrolyte complexes per this invention provide enhanced dry strength, particularly in the presence of black liquors. However, except as described below, the fibrous polyelectrolyte complexes (particularly those having the more preferred anionic charge fraction listed above) provide larger improvement in dry strength than colloidal or water-soluble polyelectrolyte complexes prepared from the same polymers. Under high shear in papermaking, these fibrous particles break into colloidal particles that provide excellent dry strength properties.

Unique properties are obtained by forming the polyelectrolyte complex by mixing the anionic and cationic components in an aqueous system at a temperature of at least 75° C. and letting the mixture cool to less than about 60° C., preferably less than 50° C. This can be achieved by adding the dry powder polymers to water heated to at least 75° C. and, then, allowing the resultant aqueous system to cool to less than about 60° C. This permits premixing of the polymers into a dry polymer mixture, which in many instances is the most preferable way of handling, e.g., shipping, packaging, storing, etc., the polymers prior to use. The same properties can be obtained by preparing separate aqueous systems of the anionic and cationic polymers, heating each of the aqueous systems to at least 75° C., mixing them together, and, then, allowing the resultant aqueous system to cool to less than about 60° C. Polyelectrolyte complexes prepared by these processes generally have an anionic charge fraction of 0.1 to 0.98, preferably 0.4 to 0.9, and most preferably 0.65 to 0.85. High shear mixing aids in the rapid preparation of these polyelectrolyte complexes, but is not necessary. Maintaining the temperature of the preparation solution, dispersion, or slurry at above about 75° C. for one hour aids in the homogenization of the mixture.

Polyelectrolyte complexes having an anionic charge fraction of less than about 0.2 prepared by heating to at least 75° C. and cooling will be water-soluble and perform in the same manner to those having the same anionic charge fraction prepared at lower temperatures. Polyelectrolyte complexes with anionic charge fractions of from about 0.2 to less than about 0.65 form colloidal particles that perform similar to the colloidal and fibrous particles prepared without heating to at least 75° C. and cooling.

When the anionic charge fraction is about 0.65 or higher and the polyelectrolyte complexes are prepared by heating to at least 75° C. followed by cooling, water-soluble polyelectrolyte complexes are obtained that perform even better as dry strength additives than the other species of this invention. These soluble polyelectrolyte complexes are also useful as shear activated flocculants, retention aids on high speed paper machines, viscosifiers and drag reduction agents, and in water treatment.

Such water-soluble complexes can be prepared from all of the aforementioned types of anionic components. However, temperatures are not normally sufficiently high during papermaking for formation of such a water-soluble polyelectrolyte complex. Therefore, to use those anionic polymers normally present in unbleached pulps, it is necessary to separate the anionic component from the pulp. This separation is normally carried out in the papermaking process, making such anionic components readily available.

Water soluble polyelectrolyte complexes can be prepared from, for example, poly(acrylamide-co-dimethyldiallyammonium chloride) and Marasperse N-3 sodium lignin sulfonate (Reed Lignin Inc., Greenwich, Conn.), or Aqualon TM CMC 7M (Aqualon Company, Wilmington, Del.), or southern pine black liquor; quaternary amine modified waxy maize starch and Marasperse N-22 sodium lignin sulfonate (Reed Lignin Inc., Greenwich, Conn.); poly(acrylamide-co-methylacryloxyethyltrimethylammonium chloride) and Marasperse N-3 sodium lignin sulfonate; and poly(acrylamide-co-methylacryloxyethyltrimethylammonium chloride) and Marasperse N-3 sodium lignin sulfonate. However, some combinations of cationic and anionic components prepared in this manner yield polyelectrolyte complexes having anionic charge fractions of 0.65 or higher that are particulate or colloidal and perform equivalent to their counterparts which are formed without heating to at least 75° C. and cooling.

Other additives useful in the papermaking process of this invention include sizes, defoamers, fillers, wetting agents, optical brighteners, inorganic salts, etc.

This invention is illustrated in the following examples, which are exemplary and not intended to be limiting. Therein, and throughout this specification, all percentages, parts, etc., are by weight, based on the weight of the dry pulp, unless otherwise indicated.

EXAMPLE 1-6

These examples demonstrate preparation of paper with improved dry strength according to the process of this invention using a water-soluble, linear, high molecular weight, low charge density, cationic polymer by itself and in combination with the water-soluble anionic polymers that result from the manufacture of wood pulp (e.g., solubilized lignins and hemicelluloses found in black liquor).

Handsheets were made on a Noble and Wood Sheet Machine (Noble and Wood Machine Co., Hoosick Falls, N.Y.) using the following:

1. Pulp: unbleached southern kraft pulp beaten to 550 Canadian Standard Freeness (CSF) at pH 8.
2. Standard Hard Water: Standard hard water having 50 ppm alkalinity and 100 ppm hardness was prepared by adding $CaCl_2$ and $NaHCO_3$ to distilled water, and adjusting the pH to 6.5 with $H_2SO_4$.
3. Black Liquor (Union Camp Corp., Savannah, Ga.):

| | | |
|---|---|---|
| Total Solids | 15.9% | (measured by Tappi Standard T650) |
| Sulfate Ash | 8.9% | |
| Sodium | 2.6% | (by atomic absorption spectroscopy) |
| Sulfur | 0.7% | (by x-ray fluorescence) |
| Lignin | 5.2% | (by UV spectroscopy) |
| Charge density | .057 | meq/g at pH 5.5 |

-continued

| | |
|---|---|
| (by colloidal titration) | .103 meq/g at pH 9.0 |

4. Defoamer: Defoamer 491A (Hercules Incorporated, Wilmington, Del.).

A 3920 ml sample of 2.5 weight % stock, from a well mixed batch of beaten pulp, was placed into a 4 liter metal beaker. Defoamer (0.025% based on cut of dry pulp) was added to the beaker and stirring was begun. Then, black liquor was added to the beaker in the amount listed in Table 1 below and stirring was continued for three minutes. The stock was transferred to the proportioner and diluted to 18 liters with the pH 6.5 standard hard water described above. Next, a cationic copolymer (indicated in the following table) was added to the stock and the pH of the stock was adjusted to 5.5 with $H_2SO_4$, and the stock was mixed for five minutes.

A clean thoroughly wetted screen was placed on an open deckle. The deckle was clamped closed and then filled with the 6.5 pH standard hard water (described above), from the white water return tank, to the bottom mark on the deckle box. A one liter aliquout of stock was drawn from the proportioner and poured into the deckle. The stock in the deckle was stirred using three rapid strokes of the dasher, the dasher was removed, and the deckle was drawn into the white water return tank. The screen and retained pulp was then transferred to the open felt at the entrance to the press.

The felted sheets were run through the press with the press weights adjusted so as to obtain a pressed sheet having 33–34% solids. Then, the sheet and screen were placed in the drum dryer, having an internal temperature of 240° F. and a throughput time of 50–55 seconds, and run through two times (during the first run the sheet was in contact with the drum and during the second run the screen was in contact with the drum.). The sheets were conditioned at 72° F. and 50% relative humidity for 24 hours. Eight sheets were prepared in this manner, with the last five being used for testing.

The handsheets were evaluated by way of the following tests:

Mullen Burst: Tappi Standard T403 ("Bursting Strength of Paper").

STFI Compression: Tappi Standard T826 ("Short Span Compressive Strength of Paperboard").

Results are shown in Table 1.

TABLE 1

Effect of Addition of Cationic Polymer

| Example No. | Polymer[1] (%)[2] | Black Liquor Solids Added (%)[2] 0 STFI (lbs/in) | 3.2 STFI (lbs/in) | 0 Mullen Burst (psi) | 3.2 Mullen Burst (psi) |
|---|---|---|---|---|---|
| 1. (Control) | — | 17.6 | 17.6 | 56.7 | 53.0 |
| 2. | 0.1 | 18.2 | 18.9 | 60.7 | 59.4 |
| 3. | 0.2 | 19.0 | 19.7 | 67.4 | 67.7 |
| 4. | 0.3 | 17.8 | 21.0 | 69.4 | 76.5 |
| 5. | 0.4 | 18.2 | 21.8 | 65.0 | 77.0 |
| 6. | 0.5 | 18.2 | 21.9 | 66.5 | 76.6 |

[1]Copolymer of 6.2 mole % diallyldimethyl ammonium chloride and 93.8 mole % acrylamide, having a RSV of 12.2 dl/g.
[2]Weight percentage, based on the weight of the dry pulp.

The data in Table 1 shows that improved results are obtained with respect to both the STFI Compression Strength and Mullen Burst tests when a cationic polymer of this invention is added to a pulp containing black liquor. Looking at the rows of data it can be seen that best STFI Compression Strength results were obtained with samples containing black liquor. Similarly, Mullen Burst results were better for samples containing black liquor than samples that did not contain black liquor at polymer levels of 0.2% or more, despite the fact that better results were obtained when the control did not contain black liquor. Looking at the columns, it can be seen that results were significantly better with samples containing black liquor having 0.2% or more of the cationic polymer. Thus, this example demonstrates formation of a polyelectrolyte complex between the cationic polymer added and the anionic polymers present in the black liquor, and that improved dry strength is obtained with the polyelectrolyte complex of this invention.

EXAMPLES 7–9

These examples illustrate the effect of molecular weight on the performance of the cationic polymer forming the polyelectrolyte complex. The procedure of examples 1–6 was repeated using 0.4%, by dry weight of the pulp, of the polymer used in examples 2–6 which was ultrasonically degraded in order to obtain samples of lower molecular weight. Results, along with data for control Example No. 1 and Example No. 4 which is included for convenience, are shown in Table 2 below.

TABLE 2

Effect of Weight of Cationic Polymer

| Example No. | Polymer RSV[1] (dl/g) | Black Liquor Solids Added (%)[2] 0 STFI (lbs/in) | 3.2 STFI (lbs/in) | 0 Mullen Burst (psi) | 3.2 Mullen Burst (psi) |
|---|---|---|---|---|---|
| 1.[3] (Control) | — | 17.6 | 17.6 | 56.7 | 53.0 |
| 4.[3] | 12.2 | 18.2 | 21.8 | 65.0 | 77.0 |
| 7. | 6.8 | 18.2 | 20.0 | 64.8 | 66.7 |
| 8. | 5.9 | 18.0 | 19.6 | 59.5 | 61.2 |
| 9. | 2.3 | 18.1 | 19.2 | 60.0 | 60.6 |

[1]Reduced specific viscosity (as defined above).
[2]Weight percentage, based on the weight of the dry pulp.
[3]From Table 1.

The above results show that improved results are obtained with respect to both the STFI Compression Strength and Mullen Burst tests with the cationic polymers per this invention having RSV's of 2 dl/g or more. Looking at the rows of data it can be seen that better STFI Compression Strength results were obtained with samples containing black liquor. Similarly, Mullen Burst results were better for samples containing black liquor than samples that did not contain black liquor. This indicates formation of a polyelectrolyte complex between the added cationic polymers and naturally present anionic polymers of the black liquor.

Looking at the columns, it can be seen that best results were obtained with samples having higher molecular weights (represented by higher RSV) and that significantly better results were obtained with sample No. 4 having a RSV in the preferred range, i.e., 12.2 dl/g, when the sample was prepared in the presence of black liquor.

EXAMPLES 10–15

These examples illustrate the effect of the charge density of the cationic polymer. Charge density was varied by preparing acrylamide copolymers having different amounts of diallyldimethyl ammonium chloride cationic monomer. The procedure of Examples 1–6 was repeated using the polymers described below. The polymers all had RSV's in the range of 8–9.5 dl/g. Results are shown in Table 3, below.

TABLE 3

Effect of Charge Density

| Example No. | Mole % Cationic Monomer in Polymer[1] | Cationic Polymer Added (%)[2] | Charge Density (meq/g) | Black Liquor Solids Added (%)[2] STFI (lbs/in) 0 | 3.2 | Mullen Burst (psi) 0 | 3.2 |
|---|---|---|---|---|---|---|---|
| 10. (Control) | — | — | — | 18.3 | 18.5 | 58.5 | 60.9 |
| 11. | 5.3 | 0.4 | 0.70 | 20.5 | 21.7 | 72.5 | 73.6 |
| 12. | 8.0 | 0.4 | 1.02 | 19.3 | 21.5 | 65.7 | 72.4 |
| 13. | 11.0 | 0.4 | 1.36 | 19.3 | 21.5 | 71.4 | 73.4 |
| 14. | 14.4 | 0.4 | 1.71 | 19.0 | 20.7 | 66.9 | 66.9 |
| 15. | 16.7 | 0.4 | 1.94 | 18.2 | 20.6 | 68.2 | 70.9 |

[1]Mole % of diallyldimethyl ammonium chloride in a cationic copolymer comprised of acrylamide and diallydimethyl ammonium chloride units.
[2]Weight percent, based on the weight of the dry pulp.

Looking at the rows, in all but one instance superior results are obtained in the presence of black liquor, indicating that a polyelectrolyte complex is being formed by the cationic polymer and the naturally present anionic polymers. Looking at the columns of data, it can be seen that there is a trend towards better results occurring with polyelectrolyte complexes of lower charge density cationic polymers.

EXAMPLES 16–22

These examples demonstrate use of a number of different cationic polymers per this invention. The procedures of Examples 1–6 was repeated using the polymers and obtaining the results shown in Table 4, below.

TABLE 4

Various Cationic Copolymers

| Example No. | Polymer | (RSV[1] (dl/g) | Cationic Polymer Added (%)[2] | Black Liquor Solids Added[2] STFI (lbs/1" width) 0 | 3.2 | Mullen Burst psi 0 | 3.2 |
|---|---|---|---|---|---|---|---|
| 16. | — | | | 17.7 | 18.4 | 58.3 | 59.6 |
| 17. | 8% MTMMS:92% acrylamide[3] | 7 | 0.4 | 19.2 | 20.5 | 67.4 | 72.5 |
| 18. | 11% MTMMS:89% acrylamide[3] | 8 | 0.4 | 19.1 | 20.0 | 67.3 | 69.9 |
| 19. | 8% ATMAC:92% acrylamide[4] | 10 | 0.4 | 18.9 | 20.1 | 67.4 | 68.7 |
| 20. | Cationic Guar, MS = 0.28[5] | — | 0.4 | 19.2 | 20.2 | 66.1 | 72.9 |
| 21. | 7.5% ATMAC:92.5% acrylamide[4] | 20.2 | 0.4 | 19.4 | 20.8 | 75.2 | 76.6 |
| 22. | 15% MAPTAC:85% acrylamide[6] | 6.6 | 0.4 | 18.3 | 19.8 | 72.6 | 66.6 |

[1]Reduced specific viscosity (as defined above).
[2]Weight percent, based on the weight of the dry pulp.
[3]Copolymer of acrylamide and methacryloyloxyethyltrimethylammonium methylsulfate.
[4]Copolymer of acrylamide and acryloyloxyethyltrimethylammonium chloride.
[5]Glycidyltrimethylammonium chloride cationizing agent. Molar substitution is 0.28.
[6]Copolymer of acrylamide and methacrylamidopropyltrimethyl ammonium chloride.

The data in Table 4 shows that improved STFI Compression Strength and Mullen Burst results are obtained using the cationic polymers of this invention. In each instance, the samples prepared with cationic polymers per this invention performed better than the control sample. STFI Compression Strength was better in each instance with black liquor. Mullen Burst results were better with the samples prepared with black liquor than samples that were not prepared with black liquor, except with respect to sample No. 22. Thus, the results indicate that a polyelectrolyte complex forms between the cationic polymers of this invention and anionic polymer present in black liquors.

EXAMPLES 23–27

These examples show the effect of addition of both anionic and cationic polymers during papermaking and the beneficial effect of addition of higher levels of anionic component. The procedures of Example 1 were repeated using 0.5% of the cationic polymer used in example 2–6 and the anionic polymers listed in Table 5, below. The results are shown below in Table 5.

TABLE 5

Addition of Natural Polymers

| Example No. | Anionic Polymer | Anionic Polymer (% Added)[1] | STFI (lbs/1" width) | Mullen Burst (psi) |
|---|---|---|---|---|
| 23. (Control) | — | — | 17.9 | 68.5 |
| 24. (Invention) | Kraft black liquor[2] | 2.4 | 19.5 | 71.0 |
| 25. (Invention) | Kraft black liquor[2] | 3.2 | 21.9 | 76.6 |
| 26. (Invention) | Kraft lignin[3] | 0.84 | 19.8 | 72.2 |
| 27. (Invention) | sodium lignin sulfonate[4] | 0.47 | 18.9 | 72.3 |

[1]Weight percentage, based on the weight of the dry pulp.
[2]Union Camp Corp., Savannah, GA. Properties listed in the discussion of Examples 1–6.
[3]Indulin AT Kraft lignin (Westvaco Corporation, New York, NY)
[4]Lignosol XD sodium lignin sulfonate (Reed Lignin, Inc., Greenwich, CT).

The data in Table 5 demonstrates that superior dry strength properties are obtained when both an anionic and cationic polymer are added during papermaking so as to form a polyelectrolyte complex. In addition, example 25 shows that improved results are achieved when the amount of anionic polymer is such that the cationic and anionic changes are nearly balanced (i.e., the charges are neutralized).

EXAMPLES 28–35

These examples illustrate the effect of using anionic polymers, other than those resulting from the pulping operation, that fall within the scope of this invention. Comparison samples prepared with anionic and cationic samples outside the scope of this invention are also presented. The procedures of examples 1–6 were repeated using 0.7% of the cationic polymer of examples 2–6, except that polyamide-epichlorohydrin was used as a cationic polymer in sample No. 35. The anionic polymers were added after the black liquor and before the cationic polymer. Results are shown in Table 6, below.

TABLE 6

| | Addition of Anionic Polymer | | |
|---|---|---|---|
| | | STFI (lbs/1" width) | |
| Example No. | Anionic Polymer (% Added)[1] | No Black Liquor | 3.2% Black Liquor Solids[1] |
| 28. | — | 16.2 | 19.1 |
| 29. | CMC 7M[2] (0.2%) | 18.7 | 19.9 |
| 30. | CMC 4M[2] (0.32%) | 19.3 | 20.5 |
| 31. | acrylamide - sodium acrylate copolymer[3] (0.5%) | 18.7 | 19.0 |
| 32. | acrylamide - sodium acrylate copolymer[4] (0.17%) | 19.1 | 19.5 |
| 33. | Poly(sodium-2-acrylamide-2-methylpropylsulfonate)[5] (0.13%) | 18.5 | 19.9 |
| 34. | Poly(sodium) acrylate[6] (0.06%) | 17.4 | 19.3 |
| 35. | Polyaminoamide eipchlorohydrin/ CMC 7M[2] (0.68%/0.35%) | 22.0 | 20.0 |

[1]Weight percent, based on the weight of the dry pulp.
[2]Carboxymethylcellulose, available from Aqualon Company, Wilmington, DE.
[3]Accostrength 86 copolymer, a copolymer of 90 mole % acrylamide and 10 mole % sodium acrylate (American Cyanamide Company, Wayne, NJ).
[4]A copolymer of 75 mole % acrylamide and 25 mole % sodium acrylate.
[5]HSP 1180 poly(sodium-2-acrylamide-2-methylpropylsulfonate) (Henkel Corporation, Ambler, PA).
[6]Acrysol LMW-45NX poly(sodium) acrylate (Rohm and Haas, Philadelphia, PA).

The data in Table 6 shows the superior dry strength properties of paper prepared with the polyelectrolyte complex of this invention.

Looking at the columns, it can be seen that all of the samples prepared in the absence of black liquor performed better than the control sample wherein no anionic polymer was used and that the samples prepared using the anionic polymers of this invention (not present naturally) performed much better than the sample prepared only with poly(sodium acrylate), an anionic polymer outside the scope of the instant invention.

Looking at the rows, it can be seen that in every sample, but sample No. 35, the sample prepared with black liquor performed better than the sample prepared without black liquor. Specifically, in Example No. 28 a polyelectrolyte complex forms with the cationic polymers and the naturally present anionic polymers in black liquor, providing improved dry strength. Examples 29 and 30 have superior dry strength compared to example 28 in the absence of black liquor, indicating formation of a polyelectrolyte complex by the cationic polymer and CMC. Similar results were found to occur with other cationic/anionic polymer combination per this invention, in the absence of black liquor, in examples 31 to 33. The lower STFI value achieved with poly(sodium) acrylate (no black liquor present) indicates that additive anionic polymers per the instant invention provide superior dry strength as compared to other additive anionic polymers.

The results obtained in example 34 in the presence of black liquor can be attributed to formation of a polyelectrolyte complex between the cationic polymer and the anionic polymers forming the black liquor.

Sample 35 is a comparative example showing the use of a cationic polymer outside the scope of the instant invention. The STFI value was lower in the presence of black liquor using this cationic polymer.

From the above, it can be seen that this invention provides superior dry strength in the presence of black liquor than in the absence of black liquor, whereas a decrease in dry strength occurs in the presence of black liquor using dry strength additives outside the scope of this invention.

EXAMPLES 36–38

These examples illustrate the effect of premixing a portion of the anionic component with the cationic polymer so as to form an aqueous system containing a polyelectrolyte complex and adding the aqueous system to a papermaking furnish. The procedure of examples 1–6 were repeated so as to prepare a control example having no cationic polymer, example 36, and a sample prepared with a cationic copolymer comprised of 87.6 mole % acrylamide units and 12.4% diallyldimethylammonium chloride units, Example 37.

Sample 38 was prepared using an additive composition comprising 86 parts of the aforementioned acrylamide copolymer and 14 parts sodium lignin sulfonate, which was premixed in a Waring blender so as to form a water-insoluble particulate polyelectrolyte complex prior to addition to the papermaking furnish according to the following procedure. In a Waring blender, 45g of a 20 weight percent solution of sodium lignin sulfonate (Lignosol XD, available from Reed Lignin Inc., Greenwich, Conn., having a charge density of 0.79 meq/g at pH 6.5) was mixed into 1833 g of a 3 weight percent solution of a copolymer comprised of 87.6 mole % acrylamide units and 12.4 mole % diallyldimethyl ammonium chloride (RSV 13; 1.51 meq/g). This mixture was diluted with demineralized water to form a 0.5 weight percent total solids solution that was slightly turbid.

This material was evaluated in handsheets using the procedures of examples 1 to 6. Results are shown in Table 7.

TABLE 7

| | Premixing Polymers | | | | |
|---|---|---|---|---|---|
| | | Black Liquor Solids Added (%)[1] | | | |
| | | 0 | 3.2 | 0 | 3.2 |
| Example No. | Cationic Polymer Added (%)[1] | STFI (lbs/1" width) | | Mullen Burst (psi) | |
| 36. (Control) | | 16.9 | 17.2 | 57.4 | 62.2 |
| 37. | 0.3 | 17.2 | 18.4 | 71.4 | 72.6 |

TABLE 7-continued

| Example No. | Cationic Polymer Added (%)[1] | Premixing Polymers: Black Liquor Solids Added (%)[1] 0 | 3.2 | 0 | 3.2 |
|---|---|---|---|---|---|
| | | STFI (lbs/1" width) | | Mullen Burst (psi) | |
| 38.[2] | 0.3 | 18.0 | 20.0 | 71.2 | 73.8 |

[1]Weight percent, based on the weight of the dry pulp.
[2]In addition, 0.05% Lignosol XD anionic polymer (Reed Lignin Inc., Greenwich, CT) was used in this example.

The data in Table 7 demonstrates that excellent dry strength properties are obtained using an anionic and cationic polymer per this invention, particularly when they are premixed to form a particulate polyelectrolyte complex prior to addition to the papermaking process. Excellent dry strength properties occur in the presence of black liquor, and superior performance to the cationic polymer only is shown in the absence of black liquor.

EXAMPLES 39–46

These examples illustrates the performance of comparative polymers. The procedure of Examples 1–6 was repeated using the following polymers: no cationic polymer, (sample No. 39); Corcat P600 polyethyleneimine (PEI) (Cordova Chemical Co. Muskegon, Mich.) (sample No. 40); poly(diallyldimethylammonium chloride) (sample No. 41); poly(acryloyloxyethyltrimethylammonium chloride) (sample No. 42); polyaminoamide epichlorohydrin resin (sample No. 43); copolymer prepared from 11 mole % styrene, 5 mole % sodium acrylate and 84 mole % acrylamide, prepared according to the procedures of Example 12 of U.S. Pat. No. 3,840,489) (sample No. 44); a copolymer prepared by mixing the copolymer of Example 44 with polyaminoamide epichlorohydrin resin according to the procedures of U.S. Pat. No. 4,002,588 (the polymers were mixed at an equal charge ratio) (sample No. 45); and a Mannich Reaction product of polyacrylamide, formaldehyde and dimethylamine, 5% molar substitution (viscosity in 0.5% solution, at pH 11, 6.5 cps), prepared according to Example 1 of South African Application 78/2037 (sample No. 46). Results are shown in Table 8, below.

TABLE 8

| Example No. | RSV[2] (dl/g) | Charge Density (meq/g)[3] | Polymer Added (%)[1] | Comparison Polymers: Black Liquor Solids Added (%)[1] 0 | 3.2 | 0 | 3.2 |
|---|---|---|---|---|---|---|---|
| | | | | STFI (lbs/1" width) | | Mullen Burst (psi) | |
| 39. (Control) | — | — | — | 17.5 | 17.8 | 61.3 | 63.2 |
| 40. | 0.4 | 16 | 0.5 | 19.1 | 18.3 | 62.5 | 61.8 |
| 41. | 1.1 | 6.2 | 0.5 | 17.0 | 15.9 | 51.5 | 53.8 |
| 42. | 5.2 | 5.2 | 0.4 | 18.8 | 18.1 | 67.7 | 67.1 |
| 43. | 0.4 | 2.5 | 0.4 | 18.6 | 18.6 | 80.1 | 77.0 |
| 44. | — | — | 0.4 | 19.7 | 19.8 | 71.1 | 71.3 |
| 45. | — | — | 0.4 | 18.8 | 18.1 | 65.7 | 69.3 |
| 46. | — | — | 0.4 | 18.3 | 18.4 | 63.1 | 60.9 |

[1]Weight percent, based on the weight of the dry pulp.
[2]Reduced specific viscosity (defined above).
[3]Calculated based on structure.

In almost every instance of using the comparative cationic polymers, either or both of STFI and Mullen Burst properties were worse when black liquor was present during the preparation of paper compared to when black liquor was not present; this, despite the fact that superior results were obtained by merely adding black liquor in the control (absence of a cationic polymer). In one instance (sample 44), negligible improvement occurred.

EXAMPLES 47–49

The following examples demonstrate a preferred embodiment of this invention wherein two aqueous systems comprising components are prepared, heated to greater than 75° C., mixed and cooled to less than about 60° C.

Separately, 196 g of a 0.5 weight percent solution of a copolymer of acrylamide and diallyldimethylammonium chloride (6 mole %) and 200 g of a solution containing the amount of Marasperse N-3 sodium lignin sulfonate (Reed Lignin Inc., Greenwich, Conn.) listed in the following table (no sodium lignin sulfonate was used in control example 47) were heated to 80° C. The two solutions were added to a baffled, heated vessel and mixed with a Cowles disperser blade for 5 minutes at 750 rpm, while the temperature was maintained at 80° C., and then the resulting aqueous system was allowed to cool to room temperature. The results are shown in Table 9 below.

TABLE 9

| Ex. | Anionic Charge Fraction | Sodium Lignin Sulfonate (g) | Nature of Polyelectrolyte Complex | Brookfield Viscosity[1] |
|---|---|---|---|---|
| 47 | 0 | 0 | None formed | 37 cps |
| 48 | 0.6 | 0.993 | 0.6 micron colloidal particle | 5.7 cps |
| 49 | 0.8 | 2.648 | soluble | 4.6 cps |

[1]60 rpm, #2 spindle.

EXAMPLES 50–54

In order to study the properties of paper prepared using the complexes of Examples 48 and 49, and complexes prepared by adding the anionic and cationic components directly to a papermaking system, the procedures of Examples 1–6 were repeated using the cationic polymer at an addition level of 0.5 weight %, by weight of dry pulp. A control sample was prepared without using an additive. The results are shown in Table 10 below.

TABLE 10

| Ex. | Additive | STFI Compression (lbs/in) | Mullen Burst (psi) |
|---|---|---|---|
| 50 | Control (none) | 14.9 | 42 |
| 51 | Complex of Example 48 | 17.6 | 88 |
| 52 | Components used in Example 48[1] | 18.2 | 72 |
| 53 | Complex of Example 49 | 19.5 | 91 |
| 54 | Components used in Example 49[1] | 17.9 | 82 |

[1]The components were added directly to the papermaking system, as 0.5% aqueous solutions, with the anionic component being added prior to the cationic.

The above table shows that premixing the components at above 75° C. and cooling them to less than about 60° C. does not significantly effect complex performance at an anionic charge fraction of 0.6, but results in superior performance at a charge fraction of 0.8. Thus, this comparison demonstrates the superiority of the water-soluble polyelectrolyte complexes of this preferred embodiment.

EXAMPLES 55–56

The following examples demonstrate a preferred embodiment of this invention.

A dry powder was prepared by mixing 0.98 g of copolymer of acrylamide and diallyldimethylammonium chloride (6 mole %) and the amount of Marasperse N-3 sodium lignin sulfonate (Reed Lignin Inc., Greenwich, Conn.) listed in the following table. The dry powder mixture was then added to 200 g of water that had been heated to 80° C. and the mixture was stirred using a Cowles disperser blade in a baffled, heated vessel for 5 minutes at 750 rpm, while the temperature was maintained at 80° C., and then allowed to cool to room temperature. The results are shown in Table 11, below.

TABLE 11

| Ex. | Anionic Charge Fraction | Sodium Lignin Sulfonate (g) | Nature of Polyelectrolyte Complex | Brookfield Viscosity[1] |
|---|---|---|---|---|
| 55 | 0.5 | 0.66 | colloidal particle | not measured |
| 56 | 0.8 | 2.65 | soluble | 5 cps |

[1]60 rpm, #2 spindle.

The properties of the polyelectrolyte complex of example 56 are similar to those of the polyelectrolyte complex of example 49, indicating that they are essentially the same. Therefore, performance would be similar to that of example 53.

From all of the above examples, it can be seen that the polyelectrolyte complex of the instant invention provides improved dry strength, particularly in papers prepared with unbleached pulp and black liquor. Therefore, the polyelectrolyte complex of this invention is suitable for use as dry strength additive in all types of paper and is particularly useful as a dry strength additive for unbleached paper and paper board.

While the invention has been described with respect to specific embodiments, it should be understood that they are not intended to be limiting and that many variations and modifications are possible without departing from the scope of this invention.

I claim:

1. A papermaking process consisting essentially of the steps of:

(1) forming an aqueous suspension consisting essentially unbleached pulp fibers, water and dissolved in the water from about 0.1 to about 5%, based on the dry weight of the pulp, of anionic polymers normally present in unbleached pulp selected from the group consisting of solubilized lignins and hemicelluloses, said anionic polymers having a charge density of less than 5 meq/g; and from about 0.1 to about 5%, based on the dry weight of the pulp, of polymer consisting essentially of at least one water-soluble, linear, high molecular weight, low charge density quaternary ammonium cationic polymer, having a reduced specific viscosity greater than 2 dl/g and a charge density of 0.2 to 4 meq/g, in an amount such that a polyelectrolyte complex will form with said anionic polymer and the cationic polymer; and (2) sheeting and drying the fibers of the pulp to form the desired cellulosic web having improved dry strength.

2. The process of claim 1 wherein the cationic polymer has a reduced specific viscosity of 10 to 25 dl/g and a charge density of 0.5 to 1.5 meq/g.

3. The process of claim 1 wherein the pulp is unbleached pulp containing black liquor.

4. The process of claim 1 wherein the source of said anionic polymers normally present in unbleached pulp is kraft black liquor.

5. The process of claim 1 wherein the source of said anionic polymers normally present in unbleached pulp is neutral sulfite brown liquor.

6. The process of claim 1 wherein the source of said anionic polymers normally present in unbleached pulp is kraft lignin.

7. The process of claim 1 wherein said anionic polymers normally present in unbleached pulp are sulfonated lignins.

8. The process of claim 1 wherein said anionic polymers normally present in unbleached pulp are oxidized lignins.

9. The process of claim 1 wherein said anionic polymers normally present in unbleached pulp are hemicelluloses.

10. The process of claim 1 wherein the cationic polymer is selected from the group consisting of cationic guar and copolymers of acrylamide and diallyldimethylammonium chloride, acryloyloxyethyltrimethylammonium chloride, methacryloyloxyethyltrimethylammonium methylsulfate, methacryloyloxyethyltrimethylammonium chloride and methacrylamidopropyltrimethylammonium chloride.

11. The process of claim 1 wherein the cationic polymer is selected from the group consisting of copolymers of acrylamide and diallyldimethylammonium chloride and methacryloyloxyethyltrimethyl ammonium chloride.

12. The process of claim 1 wherein from about 0.1 to about 2.5%, based on the dry weight of the pulp, of said cationic polymer is added to the pulp.

13. The process of claim 12 wherein the anionic charge fraction of said polyelectrolyte complex is from about 0.3 to about 0.8.

14. The process of claim 13 wherein the anionic charge fraction of said polyelectrolyte complex is from about 0.45 to about 0.6.

15. The process of claim 1 wherein the anionic charge fraction of said polyelectrolyte complex is from about 0.1 to about 0.98.

16. The process of claim 1 wherein the cationic polymer:anionic polymer weight ratio of said polyelectrolyte is from about 4:100 to about 40:1.

17. The process of claim 16 wherein the cationic polymer:anionic polymer weight ratio of said polyelectrolyte is from about 1:4 to about 4:1.

18. The process of claim 1 wherein from about 0.2 to about 5%, based on the dry weight of the pulp, of said cationic polymer is added to the pulp.

19. The process of claim 18 wherein from about 0.2 to about 2.5%, based on the dry weight of the pulp, of said cationic polymer is added to the pulp.

20. The process of claim 1 wherein from about 0.3 to about 5%, based on the dry weight of the pulp, of said cationic polymer is added to the pulp.

21. The process of claim 20 wherein from about 0.3 to about 2.5%, based on the dry weight of the pulp, of said cationic polymer is added to the pulp.

22. The process of claim 1 wherein the anionic polymer is present in an amount of from about 0.47 to about 5%, based on the dry weight of the pulp.

23. The process of claim 22 wherein the anionic polymer is present in an amount of from about 0.84 to about 2.5%, based on the dry weight of the pulp.

* * * * *